US009537217B2

(12) United States Patent
Ali et al.

(10) Patent No.: US 9,537,217 B2
(45) Date of Patent: Jan. 3, 2017

(54) BROADBAND CAPACITIVELY-LOADED TUNABLE ANTENNA

(71) Applicant: BLACKBERRY LIMITED, Waterloo (CA)

(72) Inventors: Shirook M. Ali, Milton (CA); Dong Wang, Waterloo (CA)

(73) Assignee: BLACKBERRY LIMITED, Waterloo, Ontario (CA)

( * ) Notice: Subject to any disclaimer, the term of this patent is extended or adjusted under 35 U.S.C. 154(b) by 319 days.

(21) Appl. No.: 14/038,889

(22) Filed: Sep. 27, 2013

(65) Prior Publication Data

US 2015/0091766 A1 Apr. 2, 2015

(51) Int. Cl.

| | |
|---|---|
| ***H01Q 5/00*** | (2015.01) |
| ***H01Q 5/314*** | (2015.01) |
| ***H01Q 1/24*** | (2006.01) |
| ***H01Q 5/392*** | (2015.01) |

(52) U.S. Cl.

CPC ..... *H01Q 5/314* (2015.01); *H01Q 1/243* (2013.01); *H01Q 5/392* (2015.01)

(58) Field of Classification Search

CPC ..... H01Q 5/307; H01Q 5/314; H01Q 5/321; H01Q 5/328; H01Q 5/378; H01Q 5/385; H01Q 5/392; H01Q 5/40; H01Q 9/14; H01Q 9/145; H01Q 1/50; H01Q 5/30; H01Q 5/335; H01Q 5/357; H01Q 5/364; H01Q 5/371; H04B 1/005; H04B 1/0057; H04B 1/0064; H04B 1/0067; H04B 1/0458

See application file for complete search history.

(56) References Cited

U.S. PATENT DOCUMENTS

| | | | | |
|---|---|---|---|---|
| 6,603,367 | B2 * | 8/2003 | Pao | H03B 5/187 331/107 DP |
| 6,686,817 | B2 * | 2/2004 | Zhu | H01P 1/20336 257/595 |
| 6,774,077 | B2 * | 8/2004 | Sengupta | C04B 35/495 501/137 |
| 6,801,102 | B2 * | 10/2004 | Shamsaifar | H01P 1/20363 333/174 |

(Continued)

FOREIGN PATENT DOCUMENTS

WO 20110309980 A1 12/2011

OTHER PUBLICATIONS

Gajanana G K, "Integration of Passive Components Into Integrated Circuits", Dec. 2006, IIT Madras, pp. 33-77.*

*Primary Examiner* — Sue A Purvis
*Assistant Examiner* — Patrick Holecek
(74) *Attorney, Agent, or Firm* — Perry + Currier, Inc.

(57) ABSTRACT

A broadband capacitively-loaded tunable antenna, and device there for is provided. The device comprises: an antenna feed; a first radiating arm connected to the antenna feed; a second radiating arm capacitively coupled to the first radiating arm; an adjustable reactance device connecting the second radiating arm to one or more of a ground and a third radiating arm; and, a processor in communication with the adjustable reactance device, the processor configured to adjust a reactance of the adjustable reactance device to tune a resonance frequency of a combination of the second radiating arm, the adjustable reactance device, and, when present, the third radiating arm.

12 Claims, 10 Drawing Sheets

(56) References Cited

U.S. PATENT DOCUMENTS

| | | | | |
|---|---|---|---|---|
| 7,107,033 | B2 * | 9/2006 | du Toit | H04B 1/28 332/103 |
| 7,535,312 | B2 * | 5/2009 | McKinzie, III | H03H 7/40 333/17.3 |
| 8,077,116 | B2 | 12/2011 | Shamblin et al. | |
| 8,199,057 | B2 * | 6/2012 | Ishizuka | H01Q 1/243 343/700 MS |
| 8,325,095 | B2 * | 12/2012 | Nishikido | H01Q 1/243 343/700 MS |
| 9,123,990 | B2 * | 9/2015 | Ramachandran | H01Q 1/243 |
| 2007/0069958 | A1 | 3/2007 | Ozkar | |
| 2011/0309980 | A1 | 12/2011 | Ali et al. | |
| 2012/0032862 | A1 * | 2/2012 | Ying | H01Q 1/243 343/749 |

* cited by examiner

BROADBAND CAPACITIVELY-LOADED TUNABLE ANTENNA

FIELD

The specification relates generally to antennas, and specifically to a broadband capacitively-loaded tunable antenna.

BACKGROUND

Current mobile electronic devices, such as smartphones, tablets and the like, generally have different antennas implemented to support different types of wireless protocols and/or to cover different frequency ranges. For example, LTE (Long Term Evolution) bands, GSM (Global System for Mobile Communications) bands, UMTS (Universal Mobile Telecommunications System) bands, and/or WLAN (wireless local area network) bands, cover frequency ranges from 700-960 MHz, 1710-2170 MHz, and 2500-2700 MHz and the specific channels within these bands can vary from region to region necessitating the use of different antennas for each region in similar models of devices. This can complicate both resourcing and managing the different antennas for devices in each region.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
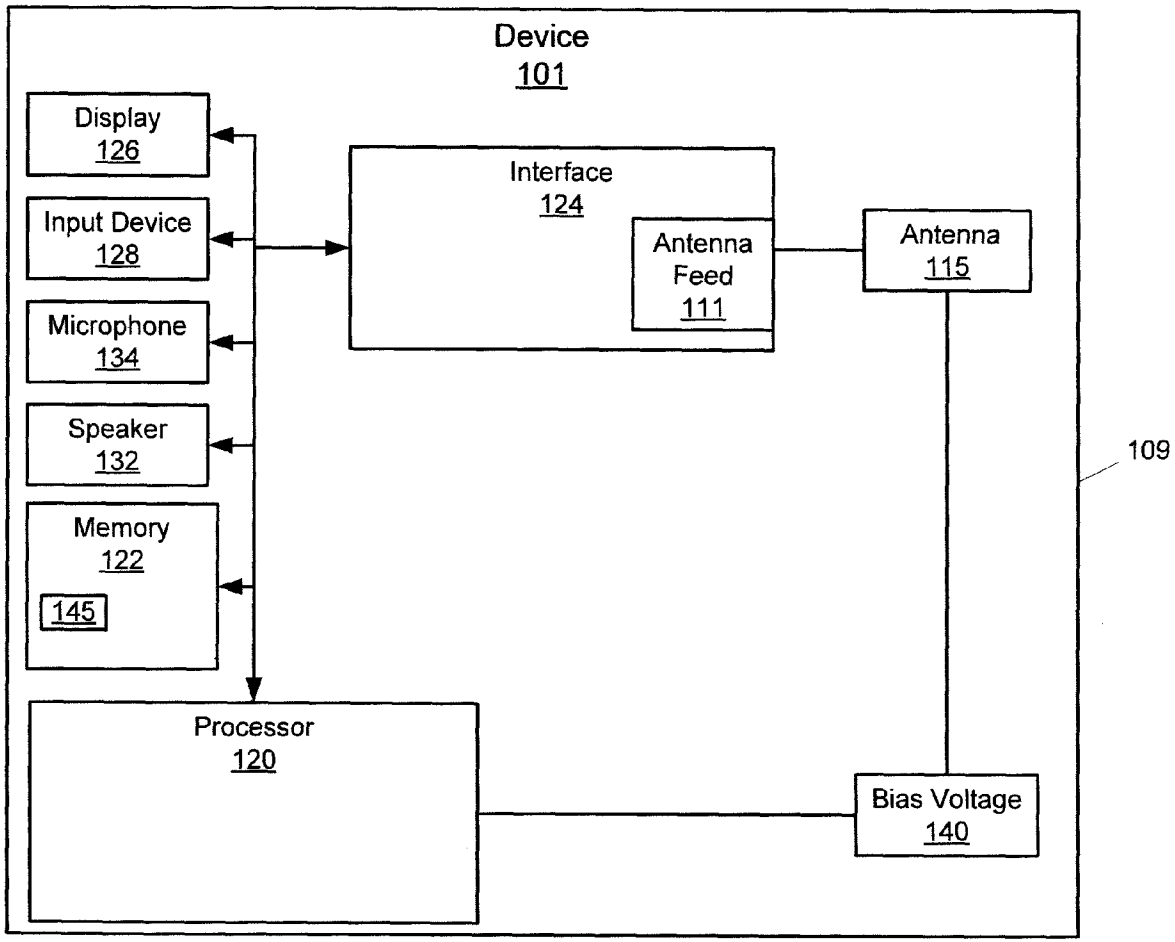
FIG. 1 depicts a schematic diagram of a device that includes a broadband capacitively-loaded tunable antenna, according to non-limiting implementations.

The present disclosure describes examples of a broadband capacitively-loaded tunable antenna that can resonate at two or more frequency responses to cover bands that can include channels for LTE bands, GSM bands, UMTS bands, and/or WLAN bands in a plurality of geographical regions. Furthermore, the frequency response of at least the lowest frequency band can be precisely tuned.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

Furthermore, as will become apparent, in this specification certain elements may be described as connected physically, electronically, or any combination thereof, according to context. In general, components that are electrically connected are configured to communicate (that is, they are capable of communicating) by way of electric signals. According to context, two components that are physically coupled and/or physically connected may behave as a single element. In some cases, physically connected elements may be integrally formed, e.g., part of a single-piece article that may share structures and materials. In other cases, physically connected elements may comprise discrete components that may be fastened together in any fashion. Physical connections may also include a combination of discrete components fastened together, and components fashioned as a single piece.

Furthermore, as will become apparent in this specification, certain antenna components may be described as being configured for generating a resonance at a given frequency and/or resonating at a given frequency and/or having a resonance at a given frequency. In general, an antenna component that is configured to resonate at a given frequency, and the like, can also be described as having a resonant length, a radiation length, a radiating length, an electrical length, and the like, corresponding to the given frequency. The electrical length can be similar to, or different from, a physical length of the antenna component. The electrical length of the antenna component can be different from the physical length, for example by using electronic components to effectively lengthen the electrical length as compared to the physical length. The term electrical length is most often used with respect to simple monopole and/or dipole antennas. The resonant length can be similar to, or different from, the electrical length and the physical length of the antenna component. In general, the resonant length corresponds to an effective length of an antenna component used to generate a resonance at the given frequency; for example, for irregularly shaped and/or complex antenna components that resonate at a given frequency, the resonant length can be described as a length of a simple antenna component, including but not limited to a monopole antenna and a dipole antenna, that resonates at the same given frequency.

An aspect of the specification provides a device comprising: an antenna feed; a first radiating arm connected to the antenna feed; a second radiating arm capacitively coupled to the first radiating arm; an adjustable reactance device connecting the second radiating arm to one or more of a ground and a third radiating arm; and, a processor in communication with the adjustable reactance device, the processor configured to adjust a reactance of the adjustable reactance device to tune a resonance frequency of a combination of the second radiating arm, the adjustable reactance device, and, when present, the third radiating arm.

The adjustable reactance device can be adjustable using one or more of: a bias voltage, a direct current bias voltage, at least one switch, and at least one microelectromechanical system (MEMS) device.

The adjustable reactance device can comprise a passive tunable integrated circuit. The processor can be further configured to adjust the reactance of the adjustable reactance device by adjusting a bias voltage to the passive tunable integrated circuit. The device can further comprise the bias voltage device and a connection between the bias voltage device and the adjustable reactance device, the processor can be further configured to adjust the reactance of the adjustable reactance device by adjusting an output voltage of the bias voltage device. The processor can be further configured to adjust the reactance of the adjustable reactance device by adjusting a capacitance of the passive tunable integrated circuit.

The first radiating arm can be configured to resonate in a first frequency range from about 1700 MHz to about 2100 MHz.

The combination of the second radiating arm, the adjustable reactance device and, when present, the third radiating arm can be configured to resonate in a first frequency range from about 740 MHz to about 960 MHz, wherein a position of resonance can be tunable based on a reactance of the adjustable reactance device.

The device can further comprise a fourth radiating arm connected to the antenna feed, the fourth radiating arm can be configured to resonate at a frequency different from the first radiating arm and the combination of the second radiating arm, the adjustable reactance device and, when present, the third radiating arm. The fourth radiating arm can be configured to resonate in a first frequency range from about 2500 MHz to about 2700 MHz.

The adjustable reactance device can couple the second radiating arm to the third radiating arm, and the second radiating arm can be connected to a ground at an end opposite the adjustable reactance device.

The device can further comprise at least a fourth radiating arm and at least a second adjustable reactance device connecting the third radiating arm to the fourth radiating arm, the processor can be further configured to adjust a respective reactance of the second adjustable reactance device to tune a respective resonance frequency of a combination of the second radiating arm, the adjustable reactance device, the third radiating arm, the second adjustable reactance device and the fourth radiating arm. One or more of the second radiating arm and the third radiating arm can comprise a three-dimensional structure incorporated onto an internal structure of the device.

The device can further comprise a matching circuit connecting the antenna feed to the first radiating arm.

FIG. 1 depicts a schematic diagram of a mobile electronic device 101, referred to interchangeably hereafter as device 101. Device 101 comprises: a chassis 109; an antenna feed 111, and a broadband capacitively-loaded tunable antenna 115, connected to the antenna feed 111, described in further detail below. Broadband capacitively-loaded tunable antenna 115 will be interchangeably referred to hereafter as antenna 115. Device 101 can be any type of electronic device that can be used in a self-contained manner to communicate with one or more communication networks using antenna 115. Device 101 can include, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations. Device 101 hence further comprises a processor 120, a memory 122, a display 126, a communication interface 124 that can optionally comprise antenna feed 111, at least one input device 128, a speaker 132 and a microphone 134. Device 101 can further comprise a bias voltage device 140 for controlling one or more components of antenna 115.

As will be described hereafter, antenna 115 comprises a first radiating arm connected to antenna feed 111; a second radiating arm capacitively coupled to the first radiating arm; and an adjustable reactance device connecting the second radiating arm to one or more of a ground and a third radiating arm. Hence, device 101 generally comprises: an antenna feed 111; a first radiating arm connected to antenna feed 111; a second radiating arm capacitively coupled to the first radiating arm; an adjustable reactance device connecting the second radiating arm to one or more of a ground and a third radiating arm; and, processor 120 in communication with the adjustable reactance device, processor 120 configured to adjust a reactance of the adjustable reactance device to tune a resonance frequency of a combination of the second radiating arm, the adjustable reactance device, and, when present, the third radiating arm.

It should be emphasized that the structure of device 101 in FIG. 1 is purely an example, and contemplates a device that can be used for both wireless voice (e.g. telephony) and wireless data communications (e.g. email, web browsing, text, and the like). However, FIG. 1 contemplates a device that can be used for any suitable specialized functions, including, but not limited to, one or more of, telephony, computing, appliance, and/or entertainment related functions.

Device 101 comprises at least one input device 128 generally configured to receive input data, and can comprise any suitable combination of input devices, including but not limited to a keyboard, a keypad, a pointing device, a mouse, a track wheel, a trackball, a touchpad, a touch screen and the like. Other suitable input devices are within the scope of present implementations.

Input from input device 128 is received at processor 120 (which can be implemented as a plurality of processors, including but not limited to one or more central processors (CPUs)). Processor 120 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 which makes appropriate utilization of volatile storage during the execution of such programming instructions. Those skilled in the art will now recognize that memory 122 is an example of computer readable media that can store programming instructions executable on processor 120. Furthermore, memory 122 is also an example of a memory unit and/or memory module.

Memory 122 further stores an application 145 that, when processed by processor 120, enables processor 120 to: adjust a reactance of an adjustable reactance device, at antenna 115, to tune a resonance frequency of a combination of second radiating arm at antenna 115, the adjustable reactance device, and, when present, a third radiating arm at antenna 115. Specifically, application 145 can enable processor 120 to control an adjustable reactance device at antenna 115 to a given reactance to control for tuning at least one resonance of antenna 115. For example, in some implementations, processor 120 can control bias voltage device 140 to a given voltage value, the given voltage value in turn applied to the adjustable reactance device to tune the adjustable reactance device to a given reactance corresponding to a given resonance frequency of antenna 115. Hence, memory 122 can also store data indicative of a relationship between given resonance frequencies and corresponding bias voltages, and tuning of resonance frequencies can be based on such data. Such data can be stored in application 145 and/or separate from application 145.

Furthermore, memory 122 storing application 145 is an example of a computer program product, comprising a non-transitory computer usable medium having a computer readable program code adapted to be executed to implement a method, for example a method stored in application 145.

Processor 120 can be further configured to communicate with display 126, and microphone 134 and speaker 132. Display 126 comprises any suitable one of, or combination of, flat panel displays (e.g. LCD (liquid crystal display), plasma displays, OLED (organic light emitting diode) displays, capacitive or resistive touchscreens, CRTs (cathode ray tubes) and the like). Microphone 134 comprises any suitable microphone for receiving sound and converting to audio data. Speaker 132 comprises any suitable speaker for converting audio data to sound to provide one or more of audible alerts, audible communications from remote communication devices, and the like. In some implementations, input device 128 and display 126 are external to device 101, with processor 120 in communication with each of input device 128 and display 126 via a suitable connection and/or link.

Processor 120 also connects to communication interface 124 (interchangeably referred to hereafter as interface 124), which can be implemented as one or more radios and/or connectors and/or network adaptors, configured to wirelessly communicate with one or more communication networks (not depicted) via antenna 115. It will be appreciated that interface 124 is configured to correspond with network architecture that is used to implement one or more communication links to the one or more communication networks, including but not limited to any suitable combination of USB (universal serial bus) cables, serial cables, wireless links, cell-phone links, cellular network links (including but not limited to 2G, 2.5G, 3G, 4G+ such as UMTS (Universal Mobile Telecommunications System), GSM (Global System for Mobile Communications), CDMA (Code division multiple access), FDD (frequency division duplexing), LTE (Long Term Evolution), TDD (time division duplexing), TDD-LTE (TDD-Long Term Evolution), TD-SCDMA (Time Division Synchronous Code Division Multiple Access) and the like, wireless data, Bluetooth™ links, NFC (near field communication) links, WLAN (wireless local area network) links, WiFi links, WiMax links, packet based links, the Internet, analog networks, the PSTN (public switched telephone network), access points, and the like, and/or a combination.

Specifically, interface 124 comprises radio equipment (i.e. a radio transmitter and/or radio receiver) for receiving and transmitting signals using antenna 115. It is further appreciated that, as depicted, interface 124 comprises antenna feed 111, which alternatively can be separate from interface 124.

Bias voltage device 140 can comprise an adjustable bias voltage device controlled by processor 120. In some implementations, bias voltage device 140 can comprise a direct current (DC) bias voltage device. An output of bias voltage device 140 can be connected to an adjustable reactance device at antenna 115, for example using one or more of a connection, a trace and the like, between the output of bias voltage device 140 and a bias voltage input of the adjustable reactance device. In some implementations, bias voltage device 140 can comprise a digital to analog control integrated circuit for controlling an adjustable reactance device.

While not depicted, device 101 further comprises a power source, for example a battery or the like. In some implementations the power source can comprise a connection to a mains power supply and a power adaptor (e.g. and AC-to-DC (alternating current to direct current) adaptor).

Device 101 further comprises an outer housing which houses components of device 101, including chassis 109. Chassis 109 can be internal to the outer housing and be configured to provide structural integrity to device 101. Chassis 109 can be further configured to support components of device 101 attached thereto, for example, display 126. In some implementations chassis 109 can comprise a one or more of a conducting material and a conducting metal, such that at least a portion of chassis 109 forms a ground and/or a ground plane of device 101; in alternative implementations, at least a portion of chassis 109 can comprise one or more of a conductive covering and a conductive coating which forms the ground plane.

In any event, it should be understood that a wide variety of configurations for device 101 are contemplated.

Figure 2:
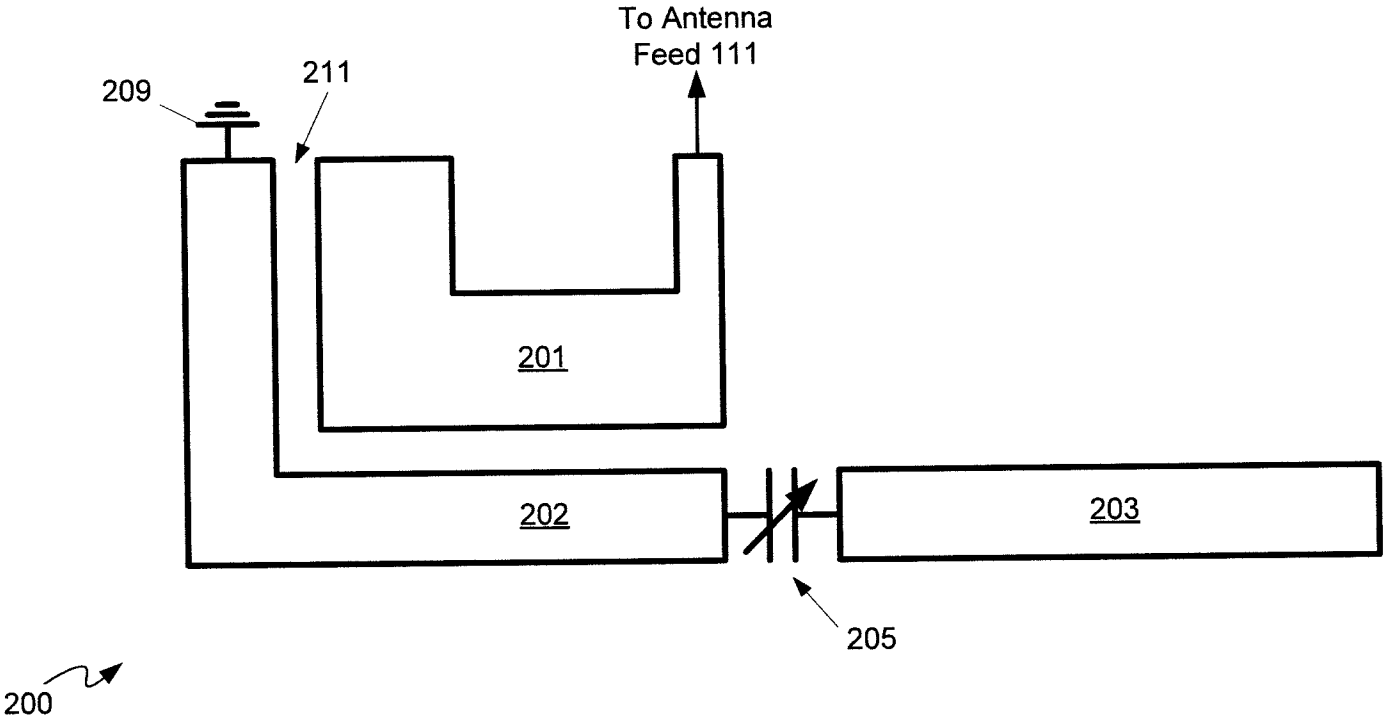
FIG. 2 depicts a schematic diagram of a broadband capacitively-loaded tunable antenna that can be used in the device of FIG. 1, according to non-limiting implementations.

It is further appreciated that antenna 115 can comprise a wide variety of configurations as described hereafter. For example, attention is next directed to FIG. 2, which depicts non-limiting implementations of an antenna 200; in some implementations, antenna 115 can comprise antenna 200.

Antenna 200 comprises: a first radiating arm 201 connected to antenna feed 111 (not depicted in FIG. 2); a second radiating arm 202 capacitively coupled to first radiating arm 201; a third radiating arm 203; and an adjustable reactance device 205 connecting second radiating arm 202 to third radiating arm 203.

It is appreciated that adjustable reactance device 205 is in communication with processor 120 (not depicted in FIG. 2), for example via bias voltage device 140, and processor 120 is configured to adjust a reactance of adjustable reactance device 205 to tune a resonance frequency of a combination of second radiating arm 202, adjustable reactance device 205, and third radiating arm 203.

An end of second radiating arm 202, opposite an end connected to adjustable reactance device 205, can be further connected to a ground 209: for example, second radiating arm 202 can be connected to chassis 109 when chassis 109 comprises a ground and/or ground plane of device 101.

Further, a gap 211 separates first radiating arm 201 from second radiating arm 202, gap 211 configured to capacitively couple first radiating arm 201 to second radiating arm 202. In other words, when first radiating arm 201 is excited by a signal and/or a driving voltage from antenna feed 111, the signal and/or driving voltage also excites second radiating arm 202 across gap 211.

While not depicted, in some implementations, device 101 can further comprise a matching circuit connecting antenna feed 111 to first radiating arm 201.

Adjustable reactance device 205 can comprise one or more of an adjustable capacitor and a passive tunable integrated circuit (PTIC). Indeed, PTICs are a class of electrical device that accept a given bias voltage (e.g. a direct current bias voltage) and, in response, tunes an adjustable capacitor therein to a corresponding given capacitance. For example, some PTICs can accept input voltages in a range from about 2 V to about 25 V, and corresponding capacitances can be in a range of about 1 pF to about 20 pF, though the exact capacitance can depend on one or more of: specifications of the adjustable capacitor, an input frequency of a signal being received by the adjustable capacitor, and the like. Further, other voltage ranges and other capacitance ranges are within the scope of present implementations.

While present implementations are described with reference to adjustable reactance device 205 comprising an adjustable capacitor, and hence capacitive reactance, other types of reactance are within the scope of present implementations, including, but not limited to, inductive reactance. In other words, in other implementations, adjustable reactance device 205 can comprise an adjustable inductor.

In yet further implementations, adjustable reactance device 205 can be combined with bias voltage device 140.

In any event, processor 120 is in communication with antenna 200 and, specifically, with adjustable reactance device 205. Processor 120 is generally configured to adjust a reactance of adjustable reactance device 205 to tune a resonance frequency of the combination of second radiating arm 202, adjustable reactance device 205 and third radiating arm 203, thereby changing a resonant length of the combination of second radiating arm 202, adjustable reactance device 205 and third radiating arm 203, depending on the reactance of adjustable reactance device 205. In other words, adjusting the reactance of the adjustable reactance device 205 results in changing one or more of a resonant length, a radiating length and an electrical length of the combination of second radiating arm 202, adjustable reactance device 205 and third radiating arm 203.

An input frequency from antenna feed 111 to antenna 200 can be controlled by one or more of processor 120 and interface 124. Hence, as device 101 switches communication modes from a first frequency band to a second frequency band (for example as a new region is detected where communications occur over the second frequency band and not the first frequency band), one or more of processor 120 and interface 124 can cause an input frequency from antenna feed 111 to antenna 200 to switch between frequencies. In conjunction with changing frequency and/or switching frequencies, processor 120 can adjust a reactance of adjustable reactance device 205 to tune a resonance frequency of antenna 200, for example from a first frequency to a second frequency.

Hence, processor 120 is further configured to adjust the reactance of adjustable reactance device 205 by adjusting a bias voltage to the passive tunable integrated circuit, for example by adjusting an output voltage of bias voltage device 140. As described above, bias voltage device 140 can comprise a DC bias voltage device. Further, device 101 can comprise a connection, and/or a trace, between bias voltage device 140 and adjustable reactance device 205, and processor 120 further configured to adjust the reactance of adjustable reactance device 205 by adjusting the DC output voltage of bias voltage device 140. In implementations where adjustable reactance device 205 comprises a PTIC, processor 120 can be further configured to adjust the reactance of adjustable reactance device 205 by adjusting a capacitance of the PTIC.

In general, a respective size, shape and length of each of first radiating arm 201 and second radiating arm 202, third radiating arm 203 and gap 211 are chosen such that: first radiating arm 201 resonates at a given first frequency and/or in a given first frequency range; and the combination of second radiating arm 202, adjustable reactance device 205 and third radiating arm 203 resonates at a given second frequency and/or in a given second frequency range.

The frequency ranges of antenna 200 can include, but are not limited to, frequency ranges associated with one or more of LTE, GSM, UMTS, WLAN, and the like.

For example, first radiating arm 201 can be configured to resonate in a frequency range of about 1700 MHz to about 2100 MHz. However, the position of the resonance of first radiating arm 201 is generally fixed once the size, shape and length of first radiating arm 201 is configured.

Similarly, the combination of second radiating arm 202, adjustable reactance device 205 and third radiating arm 203 can be configured to resonate in a frequency range from about 740 MHz to about 960 MHz. However, the position of resonance is tunable based on a reactance of the adjustable reactance device 205. In other words, processor 120 can change the resonance of the combination of second radiating arm 202, adjustable reactance device 205 and third radiating arm 203 by adjusting the reactance of adjustable reactance device 205: by adjusting the reactance of adjustable reactance device 205, one or more of a resonant length, a radiating length and an electrical length of the combination of second radiating arm 202, adjustable reactance device 205 and third radiating arm 203 changes.

It is further appreciated that second radiating arm 202 is "L" shaped, and at least a portion of each leg of the "L" forms gap 211 with first radiating arm 201. Similarly, first radiating arm 201 is "U" shaped, with a portion of two legs of the "U" forming gap 211 with second radiating arm 202. Such a configuration can be used to optimize a length of gap 211, however such a configuration is generally non-limiting, and other configurations are within the scope of present implementations, as long as dimensions of gap 211 are sufficient for capacitive coupling between first radiating arm 201 and second radiating arm 202.

Further, while third radiating arm 203 is depicted as straight, other implementations are within the scope of present implementations. For example, as described below with reference to FIG. 9, a configuration of third radiating arm 203 can be adapted for integration with one or more of an internal structure of device 101, a geometry of device 101, chassis 109, and a frame of device 101. Indeed, each of first radiating arm 201, second radiating arm 202 and third radiating arm 203 can be adapted for integration with one or more of a geometry of device 101, chassis 109, and a frame of device 101, presuming that the resonance frequency requirements for device 101 are also met.

Similarly, while second radiating arm 202 and third radiating arm 203 are depicted as being arranged along a straight line, and as having a similar width along the straight line, in other implementations, third radiating arm 203 can be at an angle to second radiating arm 202, and further can be of dimensions that are similar to, or different from, second radiating arm 202.

Further, while first radiating arm 201 is depicted as being connected to antenna feed 111 at a given position, in other implementations, first radiating arm 201 can be connected to antenna feed 111 at other positions. Indeed, the position of connection of first radiating arm 201 to antenna feed 111 is generally appreciated to be non-limiting. Further, the connection to antenna feed 111 can be fixed, and/or a removable connectable, for example using, respectively, solder or a connector.

Further, as depicted, adjustable reactance device 205 is located away from gap 211; however, in other implementations, adjustable reactance device 205 can be located adjacent gap 211.

Indeed, dimensions, geometry and the like of components of antenna 200 can be selected based on desired resonance frequencies, as described above. In some implementations, dimensions, geometry and the like can be chosen using one or more of antenna modelling software, experimentally, trial and error, and the like.

Similarly, relative sizes of second radiating arm 202 and third radiating arm 203, and/or a location of adjustable reactance device 205 there between, can be chosen using one or more of antenna modelling software, experimentally, trial and error, and the like.

In some implementations, however, third radiating arm 203 can be optional.

Figure 3:
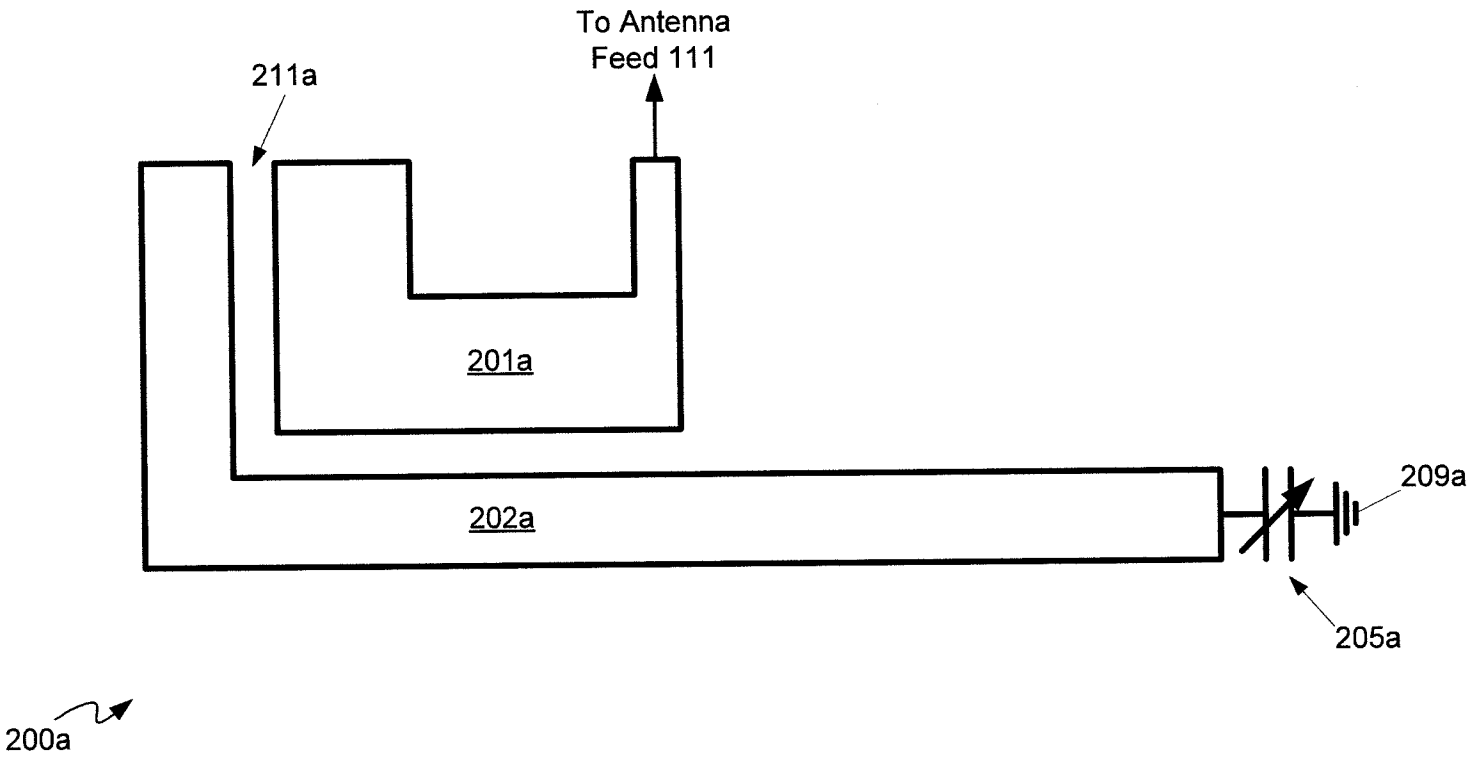
FIG. 3 depicts a schematic diagram of an alternative broadband capacitively-loaded tunable antenna that can be used in the device of FIG. 1, according to non-limiting implementations.

For example, attention is next directed to FIG. 3, which depicts non-limiting implementations of an antenna 200*a*. Antenna 115 can comprise antenna 200*a*. Antenna 200*a* is substantially similar to antenna 200 with like elements having like numbers, but with an "a" appended thereto. Hence, antenna 200*a* comprises: a first radiating arm 201*a* connected to antenna feed 111 (not depicted); a second radiating arm 202*a* capacitively coupled to first radiating arm 201*a*, for example via a gap 211*a*; and an adjustable reactance device 205*a* connecting second radiating arm 202*a* to a ground 209*a*, for example chassis 109, when chassis 109 comprises a ground and/or ground plane of device 101.

In these implementations, processor 120 is in communication with adjustable reactance device 205*a*, processor 120 configured to adjust a reactance of adjustable reactance device 205*a* to tune a resonance frequency of a combination of second radiating arm 202*a* and adjustable reactance device 205*a*. In other words, antenna 200*a* is functionally similar to antenna 200, however rather than connect second radiating arm 202*a* to a third radiating arm, adjustable reactance device 205*a* connects second radiating arm 202*a* to ground 209*a*.

Further, dimensions and geometry of second radiating arm 202*a* and adjustable reactance device 205*a* can be similar to dimensions of a combination of second radiating arm 202, adjustable reactance device 205, and third radiating arm 203, so that the combination of second radiating arm 202*a* and adjustable reactance device 205*a* resonates in a frequency range similar to a resonant frequency range of the combination of second radiating arm 202, adjustable reactance device 205 and third radiating arm 203.

Figure 4:
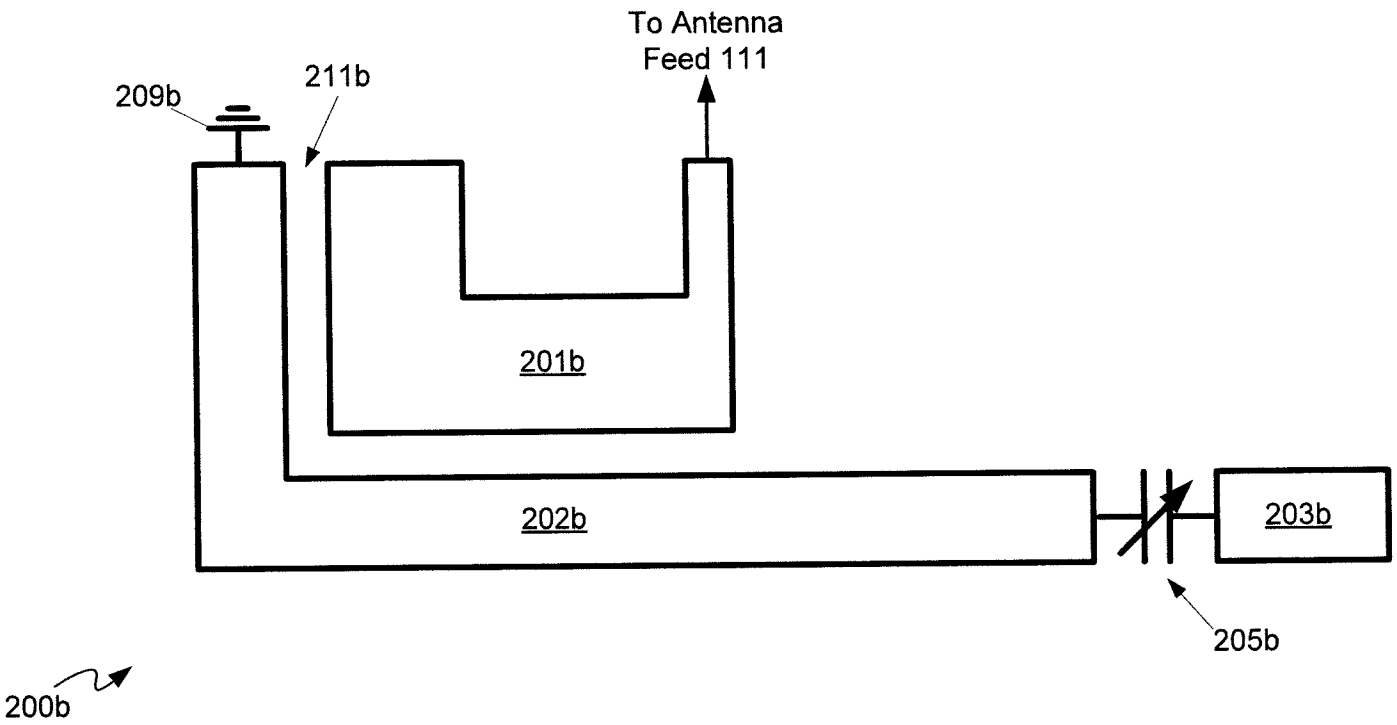
FIG. 4 depicts a schematic diagram of an alternative broadband capacitively-loaded tunable antenna that can be used in the device of FIG. 1, according to non-limiting implementations.

Other implementations of antenna 115 are within the scope of present implementations. For example, attention is next directed to FIG. 4, which depicts non-limiting implementations of an antenna 200*b*. Antenna 115 can comprise antenna 200*b*. Antenna 200*b* is substantially similar to antenna 200 with like elements having like numbers, but with a "b" appended thereto. Hence, in these implementations, antenna 200*b* comprises: a first radiating arm 201*b* connected to antenna feed 111 (not depicted); a second radiating arm 202*b* capacitively coupled to first radiating arm 201*b*, for example via a gap 211*b*; and an adjustable reactance device 205*b* connecting second radiating arm 202*b* to a third radiating arm 203*b*.

Further second radiating arm 202*b* is connected to a ground 209*b*, for example chassis 109, when chassis 109 comprises a ground and/or ground plane of device 101, at an end opposite adjustable reactance device 205*b*. In these implementations, processor 120 is in communication with adjustable reactance device 205*b*, processor 120 configured to adjust a reactance of adjustable reactance device 205*b* to tune a resonance frequency of a combination of second radiating arm 202*b*, adjustable reactance device 205*b* and third radiating arm 203*b*.

Hence, antenna 200*b* is functionally similar to antenna 200, however in these implementations, third radiating arm 203*b* is shorter than third radiating arm 203, and second radiating arm 202*b* is longer than second radiating arm 202. However, a total length of second radiating arm 202*b*, adjustable reactance device 205*b* and third radiating arm 203*b* can be similar to a respective total length of second radiating arm 202, adjustable reactance device 205 and third radiating arm 203, such resonance occurs in a similar frequency range.

Figure 5:
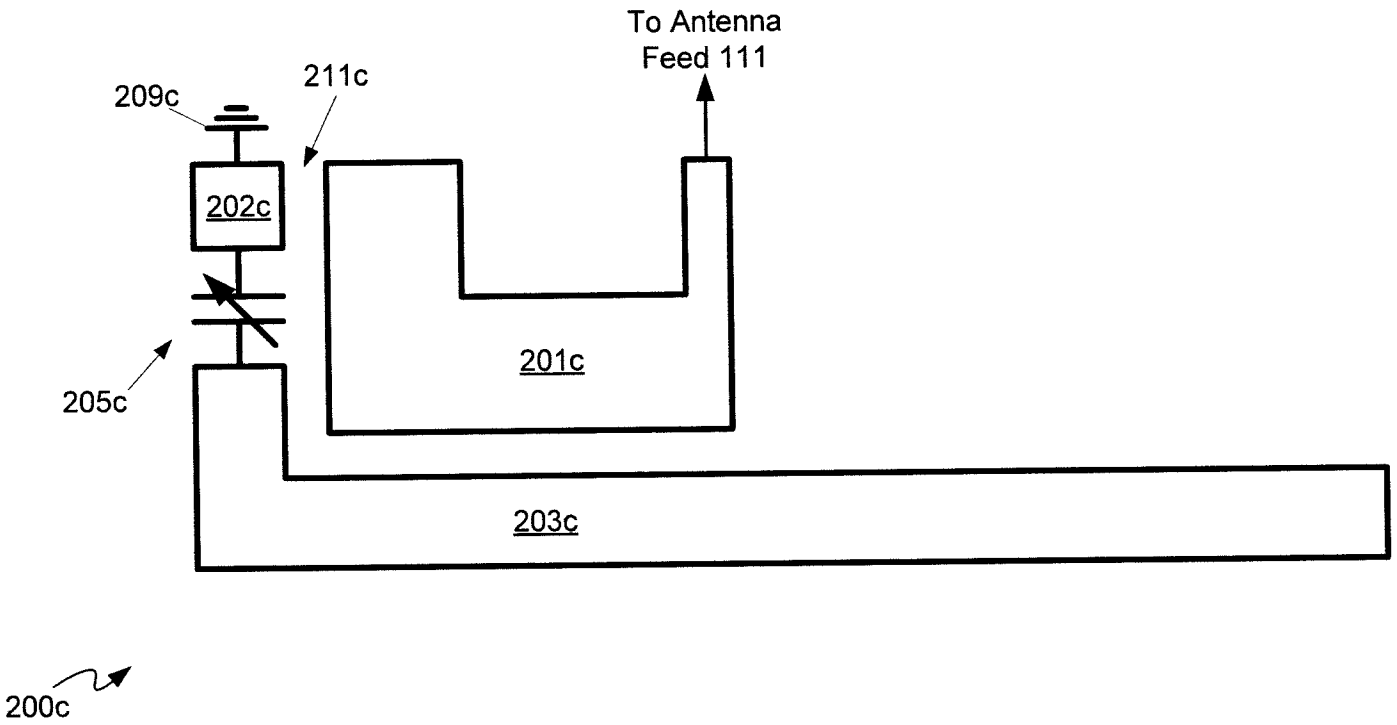
FIG. 5 depicts a schematic diagram of an alternative broadband capacitively-loaded tunable antenna that can be used in the device of FIG. 1, according to non-limiting implementations.

Similarly, attention is next directed to FIG. 5, which depicts non-limiting implementations of an antenna 200*c*. Antenna 115 can comprise antenna 200*c*. Antenna 200*c* is substantially similar to antenna 200 with like elements having like numbers, but with a "c" appended thereto. Hence, in these implementations, antenna 200*c* comprises: a first radiating arm 201*c* connected to antenna feed 111 (not depicted); a second radiating arm 202*c* capacitively coupled to first radiating arm 201*c*, for example via a gap 211*c*; and an adjustable reactance device 205*c* connecting second radiating arm 202*c* to a third radiating arm 203*c*.

Further second radiating arm 202*c* is connected to a ground 209*c*, for example chassis 109, when chassis 109 comprises a ground and/or ground plane of device 101, at an end opposite adjustable reactance device 205*c*. In these implementations, processor 120 is in communication with adjustable reactance device 205*c*, processor 120 configured to adjust a reactance of adjustable reactance device 205*c* to tune a resonance frequency of a combination of second radiating arm 202*c*, adjustable reactance device 205*c* and third radiating arm 203*c*.

Hence, antenna 200*c* is functionally similar to antenna 200, however in these implementations, third radiating arm 203*c* is longer than third radiating arm 203, and second radiating arm 202*c* is shorter than second radiating arm 202, and adjustable reactance device 205*c* is located adjacent gap 211*c*. However, a total length of second radiating arm 202*c*, adjustable reactance device 205*c* and third radiating arm 203*c* can be similar to a respective total length of second radiating arm 202, adjustable reactance device 205 and third radiating arm 203, such resonance occurs in a similar frequency range.

Figure 6:
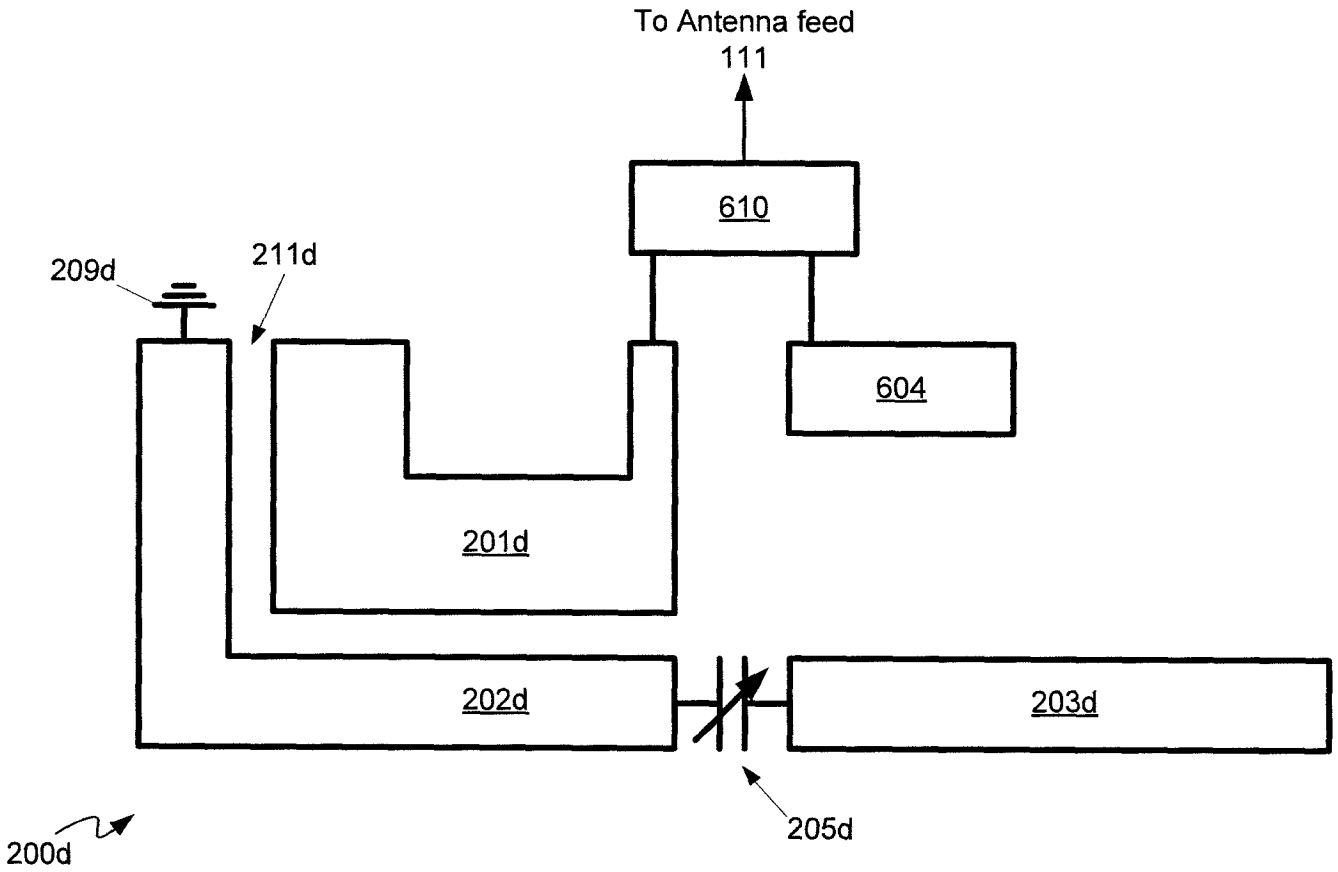
FIG. 6 depicts a schematic diagram of an alternative broadband capacitively-loaded tunable antenna that can be used in the device of FIG. 1, according to non-limiting implementations.

In implementations described heretofore, implementations of antenna 115 have been described that resonate in two frequency ranges. However, in other implementations, antenna 115 can be configured to resonate in at least three frequency ranges. For example, attention is next directed to FIG. 6, which depicts non-limiting implementations of an antenna 200*d*. Antenna 115 can comprise antenna 200*d*. Antenna 200*d* is substantially similar to antenna 200 with like elements having like numbers, but with a "d" appended thereto. Hence, in these implementations, antenna 200*d* comprises: a first radiating arm 201*d* connected to antenna feed 111 (not depicted); a second radiating arm 202*d* capacitively coupled to first radiating arm 201*d*, for example via a gap 211*d*; and an adjustable reactance device 205*d* connecting second radiating arm 202*d* to a third radiating arm 203*d*.

Further second radiating arm 202*d* is connected to a ground 209*d*, for example chassis 109, when chassis 109 comprises a ground and/or ground plane of device 101, at an end opposite adjustable reactance device 205*d*. In these implementations, processor 120 is in communication with adjustable reactance device 205*d*, processor 120 configured to adjust a reactance of adjustable reactance device 205*d* to tune a resonance frequency of a combination of second radiating arm 202*d*, adjustable reactance device 205*d* and third radiating arm 203*d*.

Hence, antenna 200*d* is functionally similar to antenna 200, with similar dimensions and/or geometry and hence resonates in frequency ranges similar to antenna 200. However in these implementations, antenna 200*d* further comprises a fourth radiating arm 604 connected to antenna feed 111, fourth radiating arm 604 configured to resonate at a frequency different from first radiating arm 201*d* and the combination of second radiating arm 202*d*, adjustable reactance device 205*d* and third radiating arm 203*d*.

For example, fourth radiating arm 604 can be configured to resonate in a frequency range of about 2500 MHz to about 2700 MHz; dimensions and/or geometry of fourth radiating arm 604 can be configured accordingly.

Furthermore, to electrically isolate first radiating arm 201*d* from fourth radiating arm 604, antenna 200*d* can further comprise a frequency filtering circuit 610, each of first radiating arm 201*d* and fourth radiating arm 604 connected to antenna feed 111 via frequency filtering circuit 610. Frequency filtering circuit 610 can be configured to electrically isolate first radiating arm 201*d* from fourth radiating arm 604 at each respective operating resonance frequency range. For example, frequency filtering circuit 610 can be configured to isolate first radiating arm 201*d* from fourth radiating arm 604 in a frequency range of about 2500 MHz to about 2700 MHz, and frequency filtering circuit 610 can be configured to isolate fourth radiating arm 604 from first radiating arm 201*d* in a frequency range of about 1700 MHz to about 2100 MHz and in a frequency range of about 740 MHz to about 960 MHz (i.e. the resonance frequency range of the combination of second radiating arm 202*d*, adjustable reactance device 205*d* and third radiating arm 203*d*).

In yet further implementations, device 101 can comprise a respective antenna feed for each of first radiating arm 201*d* and fourth radiating arm 604, so that frequency filtering circuit 610 can be eliminated. In other words, each of first radiating arm 201*d* and fourth radiating arm 604 can be connected to different antenna feeds to mitigate use of frequency filtering circuit 610.

Antenna 200*d* can be further configured to resonate at more than three frequencies by adding more radiating arms to antenna 200*d*, and adapting frequency filtering circuit 610 accordingly, and/or by adding further antenna feeds to device 101.

Figure 7:
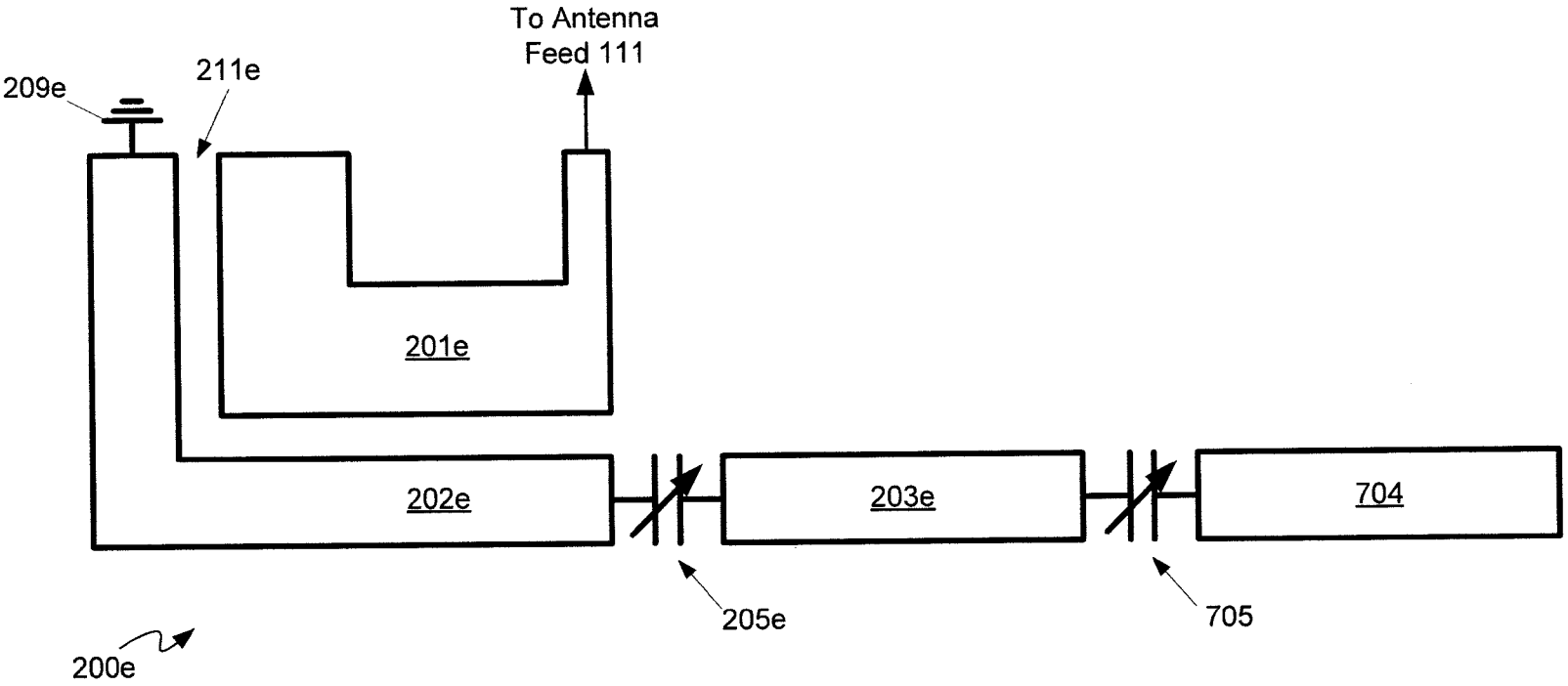
FIG. 7 depicts a schematic diagram of an alternative broadband capacitively-loaded tunable antenna that can be used in the device of FIG. 1, according to non-limiting implementations.

In some implementations, antenna 115 can comprise more than one adjustable reactance device. For example, attention is next directed to FIG. 7, which depicts non-limiting implementations of an antenna 200*e*. Antenna 115 can comprise antenna 200*e*. Antenna 200*e* is substantially similar to antenna 200 with like elements having like numbers, but with an "e" appended thereto. Hence, in these implementations, antenna 200*e* comprises: a first radiating arm 201*e* connected to antenna feed 111 (not depicted); a second radiating arm 202*e* capacitively coupled to first radiating arm 201*e*, for example via a gap 211*e*; and an adjustable reactance device 205*e* connecting second radiating arm 202*e* to a third radiating arm 203*e*.

Further second radiating arm 202*e* is connected to a ground 209*e*, for example chassis 109, when chassis 109 comprises a ground and/or ground plane of device 101, at an end opposite adjustable reactance device 205*e*.

Antenna 200*e* further comprises at least a fourth radiating arm 704 and at least a second adjustable reactance device 705 connecting third radiating arm 203*e* to fourth radiating arm 704. Second adjustable reactance device 705 can be substantially similar to, or different from adjustable reactance device 205*e*. Further, in these implementations, device 101 can comprise a second bias voltage device, similar to bias voltage device 140, in communication with processor 120, and connected to a bias voltage input of second adjustable reactance device 705. Alternatively, each of adjustable reactance device 205*e* and second adjustable reactance device 705 can be controlled using bias voltage device 140: in some of these implementations, each of adjustable reactance device 205*e* and second adjustable reactance device 705 can be controlled to the same voltage; alternatively, bias voltage device 140 can comprise two different outputs, one for each of adjustable reactance device 205*e* and second adjustable reactance device 705.

Hence, in these implementations, processor 120 is in communication with each of adjustable reactance device 205*e* and second adjustable reactance device 705, and processor 120 is further configured to adjust a respective reactance of each of adjustable reactance device 205*e* and second adjustable reactance device 705 to tune a respective resonance frequency of a combination of second radiating arm 202*e*, adjustable reactance device 205*e*, third radiating arm 203*e*, second adjustable reactance device 705 and fourth radiating arm 704.

Further, dimensions and/or geometry of components of antenna 200*e* can be configured to resonate at given frequencies, as described above.

Figure 8:
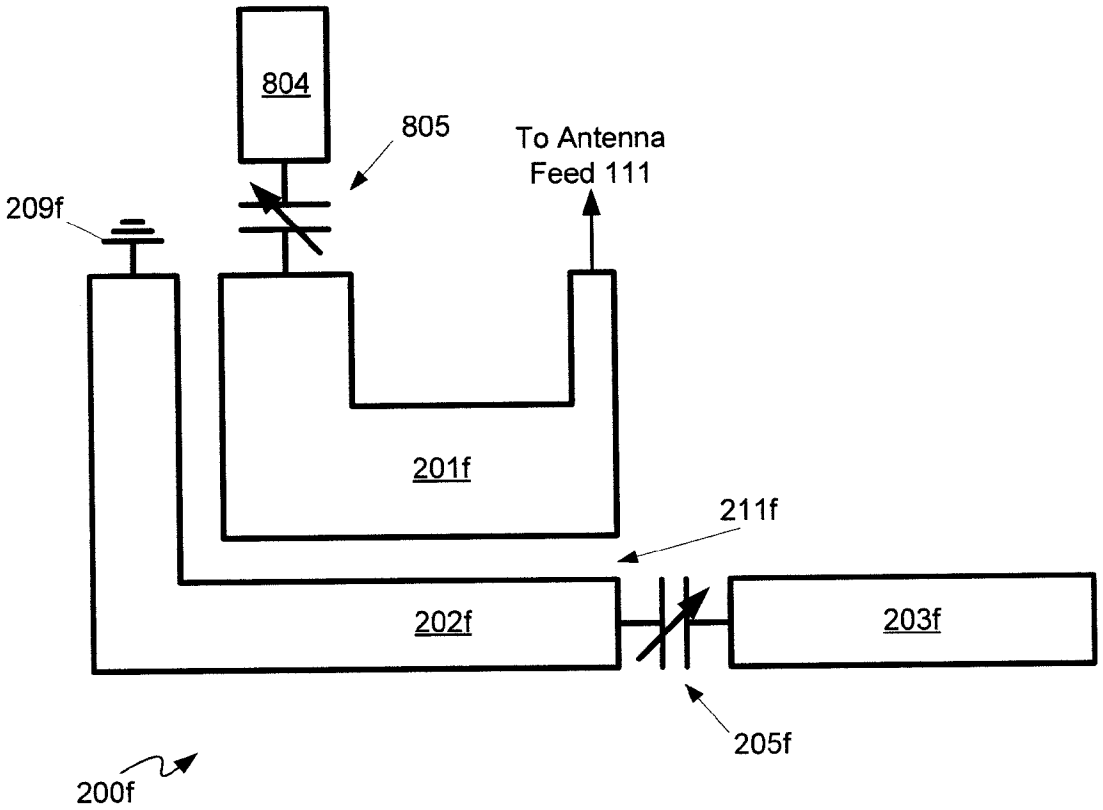
FIG. 8 depicts a schematic diagram of an alternative broadband capacitively-loaded tunable antenna that can be used in the device of FIG. 1, according to non-limiting implementations.

Indeed, any number of radiating arms and adjustable reactance devices can be incorporated into any implementation of antenna 115 described heretofore. Further, additional radiating arms and adjustable reactance devices can be incorporated into antennas 200-200*e*, including radiating arms that are connected to any of first radiating arms 201-201*e*. For example, attention is next directed to FIG. 8 which depicts non-limiting implementations of an antenna 200*f*. Antenna 115 can comprise antenna 200*f*. Antenna 200*f* is substantially similar to antenna 200 with like elements having like numbers, but with an "f" appended thereto. Hence, in these implementations, antenna 200*f* comprises: a first radiating arm 201 f connected to antenna feed 111 (not depicted); a second radiating arm 202*f* capacitively coupled to first radiating arm 201*f*, for example via a gap 211*f*; and an adjustable reactance device 205*f* connecting second radiating arm 202*f* to a third radiating arm 203*f*.

Further second radiating arm 202*f* is connected to a ground 209*f*, for example chassis 109, when chassis 109 comprises a ground and/or ground plane of device 101, at an end opposite adjustable reactance device 205*f*. In these implementations, processor 120 is in communication with adjustable reactance device 205*f*, processor 120 configured to adjust a reactance of adjustable reactance device 205*f* to tune a resonance frequency of a combination of second radiating arm 202*f*, adjustable reactance device 205*f* and third radiating arm 203*f*.

Antenna 200*f* further comprises at least a fourth radiating arm 804 and at least a second adjustable reactance device 805 connecting first radiating arm 201*f* to fourth radiating arm 804. Second adjustable reactance device 805 can be substantially similar to, or different from adjustable reactance device 205*f*. Further, in these implementations, device 101 can comprise a second bias voltage device, similar to bias voltage device 140, in communication with processor 120, and connected to a bias voltage input of second adjustable reactance device 805. Alternatively, each of adjustable reactance device 205f and second adjustable reactance device 805 can be controlled using bias voltage device 140: in some of these implementations, each of adjustable reactance device 205*f* and second adjustable reactance device 805 can be controlled to the same voltage; alternatively, bias voltage device 140 can comprise two different outputs, one for each of adjustable reactance device 205*f* and second adjustable reactance device 805.

Hence, in these implementations, processor 120 is in communication with each of adjustable reactance device 205*f* and second adjustable reactance device 805, and processor 120 is further configured to adjust a respective reactance of each of adjustable reactance device 205*f* and second adjustable reactance device 805 to tune a respective resonance frequency of: a combination of second radiating arm 202*f*, adjustable reactance device 205*f*, third radiating arm 203*f*; and a combination of first radiating arm 201*f*, second adjustable reactance device 805 and fourth radiating arm 804.

In some implementations, one or more of radiating arms in antenna 115 can comprise a three-dimensional structure incorporated onto an internal structure of device 101 including, but not limited to, chassis 109, a frame of device 101, and the like. In other words, one or more of radiating arms in antenna 115 can be adapted for integration with one or more of an internal structure of device 101, a geometry of device 101, chassis 109, and a frame of device 101.

Figure 9:
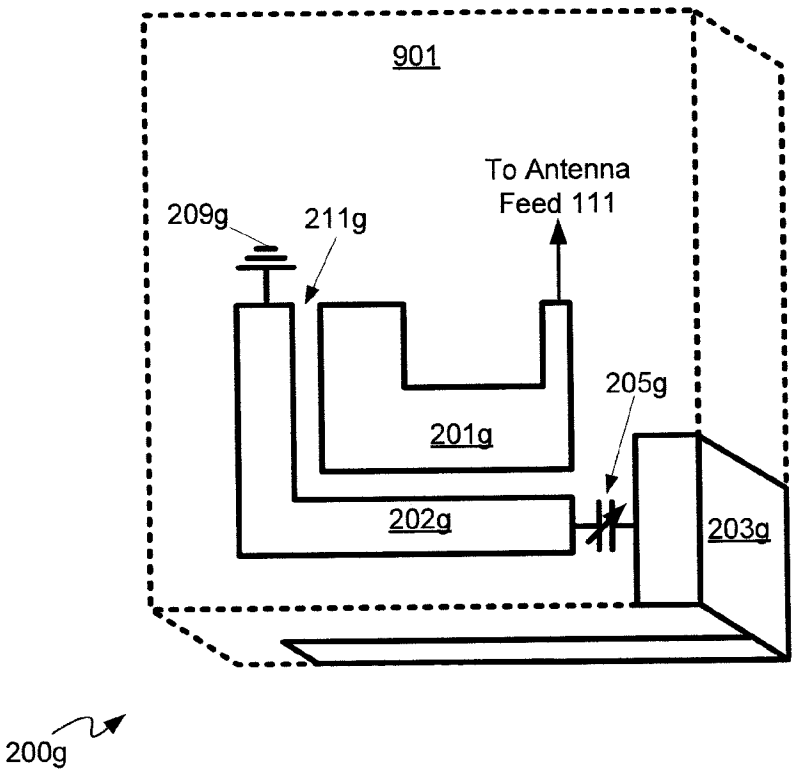
FIG. 9 depicts a schematic diagram of an alternative broadband capacitively-loaded tunable antenna that can be used in the device of FIG. 1, according to non-limiting implementations.

For example, attention is next directed to FIG. 9 which depicts non-limiting implementations of an antenna 200*g*. Antenna 115 can comprise antenna 200*g*. Antenna 200*g* is substantially similar to antenna 200 with like elements having like numbers, but with a "g" appended thereto. Hence, in these implementations, antenna 200*g* comprises: a first radiating arm 201*g* connected to antenna feed 111 (not depicted); a second radiating arm 202*g* capacitively coupled to first radiating arm 201*g*, for example via a gap 211*g*; and an adjustable reactance device 205*g* connecting second radiating arm 202*g* to a third radiating arm 203*g*.

Further second radiating arm 202*g* is connected to a ground 209*g*, for example chassis 109, when chassis 109 comprises a ground and/or ground plane of device 101, at an end opposite adjustable reactance device 205*g*. In these implementations, processor 120 is in communication with adjustable reactance device 205*g*, processor 120 configured to adjust a reactance of adjustable reactance device 205*g* to tune a resonance frequency of a combination of second radiating arm 202*g*, adjustable reactance device 205*g* and third radiating arm 203*g*.

Hence, antenna 200*g* is similar to antenna 200, however third radiating arm 203*g* comprises a three-dimensional structure that is incorporated onto an internal structure 901 of device 101. Internal structure 901 generally comprises a box-shape, and can comprise one or more non-conducting portions of chassis 109, non-conducting portions of a frame of device 101, and the like. Alternatively, when internal structure 901 is generally conducting, an insulating material can be placed between each of first radiating arm 201*g*, second radiating arm 202*g*, third radiating arm 203*g*, adjustable reactance device 205*g* and internal structure 901. Internal structure 901 is depicted in outline for clarity.

In any event, third radiating arm 203*g* extends along a top side of internal structure 901, down a side edge of internal structure 901, and then along a front edge of internal structure 901. However the terms "top", "right" and "front" are appreciated to be for illustrative purposes only, relative only to FIG. 9, and is not meant to mean that a position of third radiating arm 203*g* is fixed with respect to the Earth.

Figure 10:
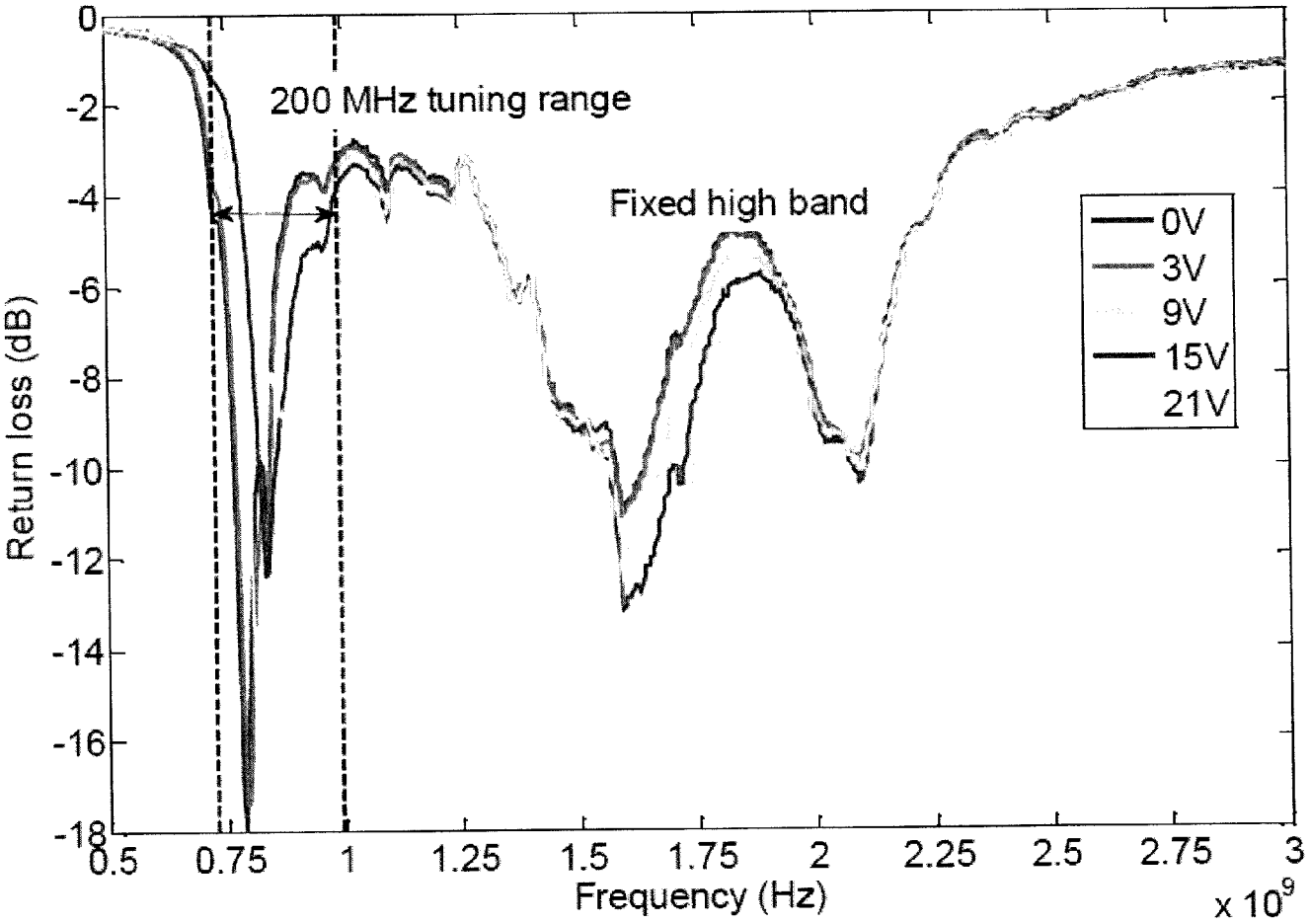
FIG. 10 depicts return-loss curves of the broadband capacitively-loaded tunable antenna of FIG. 9, at different input DC bias voltages to an adjustable reactance device, according to non-limiting implementations.

Attention is next directed to FIG. 10, which depicts return-loss curves for specific non-limiting implementations of a successful prototype of antenna 200*g*, at various input DC voltage bias values at adjustable reactance device 205*g*: for example, each return-loss curve of FIG. 10 is obtained after processor 120 controls adjustable reactance device 205*g* to input DC voltage bias values of 0 V, 3 V, 9 V, 15 V, and 21 V.

FIG. 10 specifically depicts return-loss on the y-axis for antenna 200*g* as a function of frequency, on the x-axis, in a range of 500 MHz ($0.5\times10^9$ Hz) to 3000 MHz ($3\times10^9$ Hz).

In these implementations, first radiating arm 201*g* comprises dimensions that cause first radiating arm 201*g* to resonate in a range of about 1500 MHz to about 1800 MHz with a peak at about 1600 MHz.

Further, the combination of second radiating arm 202*g*, adjustable reactance device 205*g* and third radiating arm 203*g* has dimensions that cause the combination of second radiating arm 202*g*, adjustable reactance device 205*g* and third radiating arm 203*g* to resonate in a range of about 750 MHz to about 950 MHz with peaks that depend on the input DC bias voltage to adjustable reactance device 205*g*. In these implementations, adjustable reactance device 205*g* comprises a PTIC that can accept an input DC voltage bias ranging from 0 V to at least 21 V.

It is apparent, from FIG. 10, that at a 0 V input DC bias voltage, the combination of second radiating arm 202*g*, adjustable reactance device 205*g* and third radiating arm 203*g* has a resonance peak at about 780 MHz; in contrast, at a 21 V input DC bias voltage, the combination of second radiating arm 202*g*, adjustable reactance device 205*g* and third radiating arm 203*g* has a resonance peak at about 920 MHz. At voltages between 0 V and 21 V the resonance peak shifts from about 780 MHz to about 920 MHz. Hence, by controlling the input DC bias voltage to adjustable reactance device 205*g*, a position of the resonance between 750 MHz and 950 MHz can be adjusted.

In other words, when resonance at a given frequency is desired, processor 120 can tune adjustable reactance device 205*g* by adjusting the in DC bias voltage. Further, as described above, memory 122 can store data indicative of resonance frequency as a function of input DC bias voltage; and, when device 101 is to be tuned to a given resonance frequency, processor 120 adjusts the input DC bias voltage of adjustable reactive device 205*g* to the corresponding value.

In contrast to resonance in the 750 MHz to 950 MHz range, when the input DC bias voltage to adjustable reactance device 205*g* is adjusted, there is no change in the position of the 1600 MHz resonance; while the width of the 1600 MHz resonance changes, the change in width is not enough to affect operation of antenna 200*g* at the 1600 MHz resonance.

From FIG. 10, it is further apparent that there is another resonance peak at about 2100 MHz that is not also affected by adjustments to the input DC bias voltage to adjustable reactance device 205*g*.

While in the specific non-limiting implementation of antenna 200*g*, described with reference to FIG. 10, resonances occur at about 750 MHz to 950 MHz, at about 1600 MHz, and at about 2100 MHz, in other implementations, antenna 200*g* can resonate at other frequencies, depending on the dimensions and/or geometry of each of first radiating arm 201*g*, second radiating arm 202*g*, and third radiating arm 203*g*. However, such resonance can occur in frequency bands associated with standards that can include, but are not limited to, one or more of LTE, GSM, UMTS, WLAN, and the like.

Further, antenna 200*g* can be configured to resonate in further frequency ranges, and/or configured to control further resonance frequency positions, by adding further radiating arms and/or further adjustable reactance devices to antenna 200*g*, as described above with reference to FIGS. 6 to 8.

Persons skilled in the art will appreciate that there are yet more alternative implementations and modifications possible. For example, while adjustable reactance devices (including, but not limited to, tunable capacitors, tunable/switchable inductors, PTICs, etc.) have been heretofore described herein as being adjustable using a biasing voltage, other implementations include adjustable reactance devices that can be adjusted using one or more of: at least one switch, at least one microelectromechanical system (MEMS) device, and the like. For example, the adjustable reluctance device can comprise a plurality of fixed reluctance devices connected in series and/or in parallel using at least one switch and/or at least one MEMS device, and the at least one switch and/or the at least one MEMS device can be opened and/or closed to connect the plurality of fixed reluctance device in different configurations, thereby changing and/or adjusting the total reluctance of the adjustable reluctance device. Opening and closing of the at least one switch and/or the at least one MEMS device can be controlled by processor 120.

In any event, broadband capacitively-loaded tunable antennas are described herein that can replace a plurality of antennas at a mobile electronic device. The specific resonance bands of the antennas described herein can be varied by varying the dimensions of components of the antenna to advantageously align the bands with bands used by service providers and/or communication providers, and by providing an adjustable reactance device connecting one radiating arm to one or more of a ground and another radiating arm, and adjusting a reactance of the adjustable reactance device to tune the antenna to a frequency that is dependent on a reactance of the adjustable reactance device. Further, the present antenna obviates the need to use different antennas for different bands in different regions as at least one of the bands is tunable by adjusting the adjusting reactance device to a given reactance, which in turn tunes a resonance frequency of the antenna.

Those skilled in the art will appreciate that in some implementations, the functionality of device 101 can be implemented using pre-programmed hardware or firmware elements (e.g., application specific integrated circuits (ASICs), electrically erasable programmable read-only memories (EEPROMs), etc.), or other related components. In other implementations, the functionality of device 101 can be achieved using a computing apparatus that has access to a code memory (not shown) which stores computer-readable program code for operation of the computing apparatus. The computer-readable program code could be stored on a computer readable storage medium which is fixed, tangible and readable directly by these components (e.g., removable diskette, CD-ROM, ROM, fixed disk, USB drive). Furthermore, it is appreciated that the computer-readable program can be stored as a computer program product comprising a computer usable medium. Further, a persistent storage device can comprise the computer readable program code. It is yet further appreciated that the computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., microwave, infrared, free-space optical or other transmission schemes) or a combination thereof.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is to be limited by the claims appended hereto.

What is claimed is:

1. A device comprising:

an antenna feed;

a frequency filtering circuit;

a first radiating arm coupled to the antenna feed using the frequency filtering circuit;

a second radiating arm capacitively coupled to the first radiating arm;

an adjustable reactance device connecting the second radiating arm to a third radiating arm;

a bias voltage device in communication with the adjustable reactance device;

a fourth radiating arm coupled to the antenna feed using the frequency filtering circuit, the fourth radiating arm configured to resonate at a frequency different from the first radiating arm and a combination of the second radiating arm, the adjustable reactance device and the third radiating arm, the frequency filtering circuit coupling each of the first radiating arm and a fourth radiating arm to the antenna feed, the frequency filtering circuit configured to electrically isolate the first radiating arm from the fourth radiating arm at each respective operating resonance frequency range; and, a processor in communication with the bias voltage device and the adjustable reactance device, the processor configured to adjust a reactance of the adjustable reactance device to tune a resonance frequency of the combination of the second radiating arm, the adjustable reactance device, and the third radiating arm by adjusting the bias voltage device to a given voltage, the given voltage in turn applied to the adjustable reactance device by the bias voltage device.

2. The device of claim 1, wherein the adjustable reactance device is adjustable using one or more of: a bias voltage, a direct current bias voltage, at least one switch, and/or at least one microelectromechanical system (MEMS) device.

3. The device of claim 1, wherein the adjustable reactance device comprises a passive tunable integrated circuit.

4. The device of claim 3, wherein the bias voltage device applies the given voltage to the passive tunable integrated circuit.

5. The device of claim 3, wherein the processor is further configured to adjust the reactance of the adjustable reactance device by adjusting a capacitance of the passive tunable integrated circuit.

6. The device of claim 1, wherein the first radiating arm is configured to resonate in a first frequency range from about 1700 MHz to about 2100 MHz.

7. The device of claim 1, wherein the combination of the second radiating arm, the adjustable reactance device, and the third radiating arm is configured to resonate in a first frequency range from about 740 MHz to about 960 MHz, wherein a position of resonance is tunable based on a reactance of the adjustable reactance device.

8. The device of claim 1, wherein the fourth radiating arm is configured to resonate in a first frequency range from about 2500 MHz to about 2700 MHz.

9. The device of claim 1, wherein the second radiating arm is connected to a ground at an end opposite the adjustable reactance device.

10. The device of claim 9, further comprising at least a fifth radiating arm and at least a second adjustable reactance device connecting the third radiating arm to the fifth radiating arm, the processor further configured to adjust a respective reactance of the second adjustable reactance device to tune a respective resonance frequency of a combination of the second radiating arm, the adjustable reactance device, the third radiating arm, the second adjustable reactance device and the fifth radiating arm.

11. The device of claim 9, wherein one or more of the second radiating arm and the third radiating arm comprises a three-dimensional structure incorporated onto on internal structure the device.

12. The device of claim 1, further comprising a matching circuit connecting the antenna feed to the first radiating arm.

* * * * *